United States Patent [19]

Miller

[11] 4,058,316

[45] Nov. 15, 1977

[54] ELECTRONIC CONTROL AND TEST CIRCUIT FOR PINBALL TYPE GAMES

[75] Inventor: Anthony J. Miller, Skokie, Ill.

[73] Assignee: The Seeburg Corporation, Chicago, Ill.

[21] Appl. No.: 742,634

[22] Filed: Nov. 17, 1976

[51] Int. Cl.[2] ..... A63D 13/00

[52] U.S. Cl. ..... 273/121 A; 364/900

[58] Field of Search ..... 273/118 A, 119 A, 120 A, 273/121 A, 122 A, 85 R, 123 A, 124 A, 125 A, 138 A, DIG. 28; 235/92 GA; 340/172.5, 323 R; 444/1

[56] References Cited

U.S. PATENT DOCUMENTS

| | | | |
|---|---|---|---|
| 3,341,824 | 9/1967 | Wissick et al. | 340/172.5 |
| 3,813,647 | 5/1974 | Loo | 340/172.5 |
| 3,874,669 | 4/1975 | Ariano | 273/85 R |
| 3,889,956 | 6/1975 | Castle | 273/138 A |
| 4,008,893 | 2/1977 | Yoseloff | 273/85 R |

OTHER PUBLICATIONS

*Electronics;* "Scamp Microprocessor Aims to Replace Mechanical Logic"; Sept. 18, 1975; pp. 81–85.

*Popular Electronics;* "TV Dazzler"; Feb. 1976; pp. 31, 37–40.

*Popular Electronics;* "Altair 8800"; Jan. 1975; pp. 33–38.

*Electronics; "Two New Approaches Simplify Testing of Microprocessors"; Jan. 22, 1976; pp. 100–105.*

*Primary Examiner*—Richard C. Pinkham
*Assistant Examiner*—Vane Y. Hum
*Attorney, Agent, or Firm*—McDougall, Hersh & Scott

[57] ABSTRACT

An electronic test circuit is disclosed for pinball type games. A microprocessor is programmed to provide scoring responsive to detecting the actuation of the various switches located on the game surface. A sequencing device controls operation of the microprocessor to perform a test routine whereby the microprocessor will sequentially operate every light, ball ejector and switch position to permit testing of these devices for possible repair or replacement. The sequencing device can cause the microprocessor to continuously cycle through all of the test positions or can cause the microprocessor to single step through each test position and repeat testing of a given position as often as necessary to correct a located defect.

10 Claims, 4 Drawing Figures

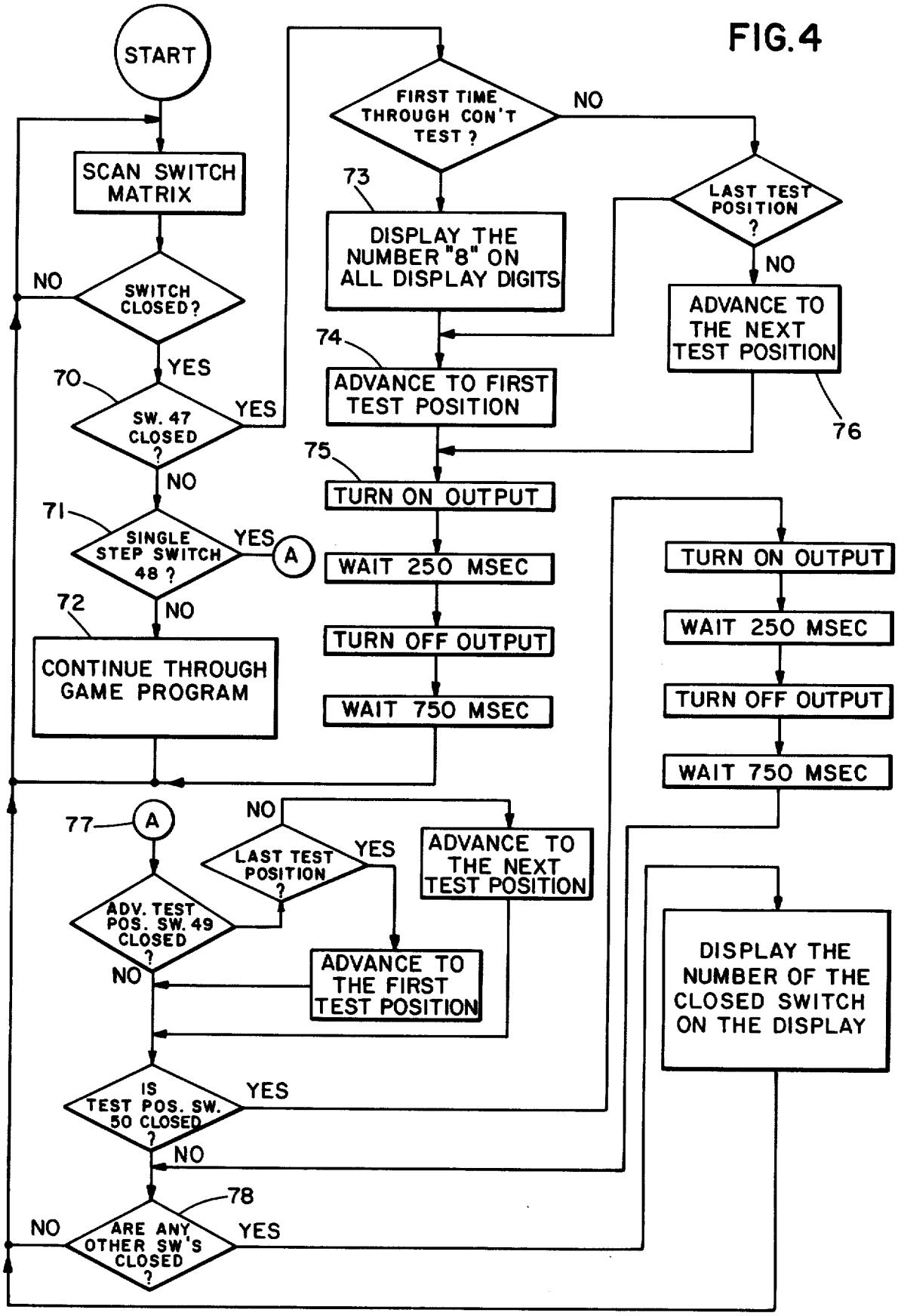
FIG. 4
START
SCAN SWITCH MATRIX
SWITCH CLOSED?
NO
YES
70
SW. 47 CLOSED ?
YES
NO
71
SINGLE STEP SWITCH 48 ?
YES
A
NO
72
CONTINUE THROUGH GAME PROGRAM
FIRST TIME THROUGH CON'T TEST ?
NO
73
DISPLAY THE NUMBER "8" ON ALL DISPLAY DIGITS
74
ADVANCE TO FIRST TEST POSITION
75
TURN ON OUTPUT
WAIT 250 MSEC
TURN OFF OUTPUT
WAIT 750 MSEC
LAST TEST POSITION ?
NO
ADVANCE TO THE NEXT TEST POSITION
76
TURN ON OUTPUT
WAIT 250 MSEC
TURN OFF OUTPUT
WAIT 750 MSEC
DISPLAY THE NUMBER OF THE CLOSED SWITCH ON THE DISPLAY
77
A
NO
LAST TEST POSITION ?
YES
ADVANCE TO THE NEXT TEST POSITION
ADV. TEST POS. SW. 49 CLOSED ?
NO
ADVANCE TO THE FIRST TEST POSITION
IS TEST POS. SW. 50 CLOSED ?
YES
NO
78
ARE ANY OTHER SW'S CLOSED ?
NO
YES

ELECTRONIC CONTROL AND TEST CIRCUIT FOR PINBALL TYPE GAMES

BACKGROUND OF THE INVENTIONS

This invention relates to the field of amusement devices. More specifically, it relates to pinball type amusement devices in which a metal ball is permitted to roll on an inclined game surface striking various obstacles placed in its path. Upon striking such obstacles, switches are actuated causing a scoring device to be incremented and occasionally altering the direction of travel of the ball. Such devices are well known and have been in use for many years. Principally, these devices employ electromechanical relays, switches, and ball ejectors. Scoring and game information, such as the number of balls played and the number of balls remaining, have been determined by the use of drum-type mechanical rotary counters. As can be appreciated, such pinball games are complex devices often requiring service. Recently the advent of sophisticated electronic circuitry has made possible the elimination of some of the electromechanical components in such a pinball game. In particular, the complex devices previously utilized for calculating and displaying the score have been replaced with simple digital displays driven by a microprocessor.

In addition to simplifying the internal operation of the games while leaving them unchanged as far as the player is concerned, it is desirable to provide increased reliability and serviceability for these games so that when servicing is required it can be more quickly and efficiently accomplished. With the incorporation of digital electronics it is possible to provide built in testing sequences for the game. In particular, it is possible to program the microprocessor to perform a test routine which will sequentially operate every light, switch and ejector device in the game so that a serviceman can positively determine that all game functions are working.

Of the devices of which applicant is aware which employ microprocessors none has the capability for testing the game functions one at a time in which each function under test can be repetitively tested to facilitate repair.

It is accordingly an object of the present invention to provide a control and test circuit for a pinball type game which circuit includes the capability for repetitively testing a given game function.

It is another object of the present invention to provide a pinball type amusement device which is controlled by a microprocessor which is programmed with a testing sequence which can repetitively test a given light, ejector or switch position until that position is satisfactorily operating.

It is a further object of the invention to provide a control and testing circuit for use by a serviceman which, when actuated, will cause a controlling microprocessor to initiate a test sequence to operate all lights, ejectors and switch positions.

Other objects and advantages of the invention will be apparent from the remaining portion of the specification.

BRIEF DESCRIPTION OF THE DRAWINGS

FIG. 4 is a flow diagram of the program utilized by the microprocessor in performing the testing sequence.

DETAILED DESCRIPTION

Figure 1:
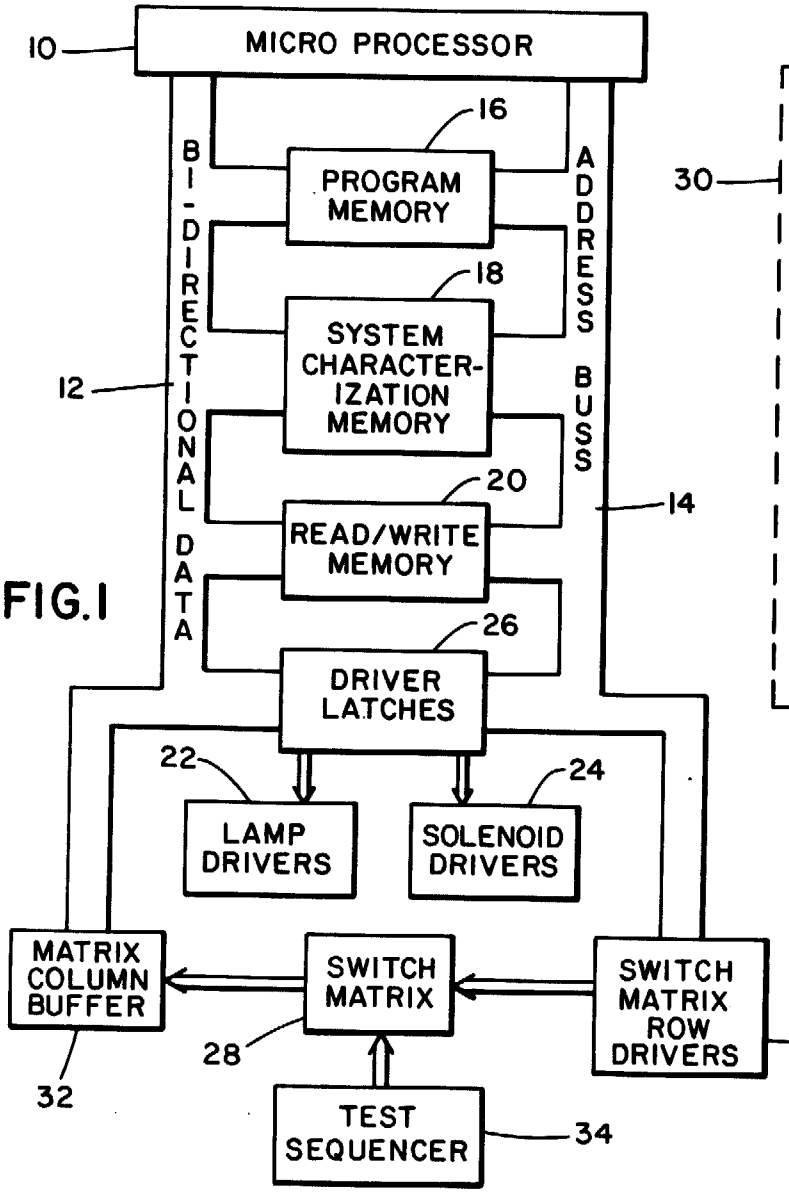
FIG. 1 is a block diagram of the circuit according to the invention.

Referring to FIG. 1, a block diagram of the control circuit according to the invention is illustrated. The circuit employs a commercially available microprocessor 10 as, for example, the type manufactured by National Semiconductor. For the purpose of the present disclosure, the microprocessor is understood to include the usual control decoder for routing data down the bi-directional data bus 12 and the address bus 14. Associated with the microprocessor 10 is the program memeory 16, a system characterization memory 18, and a read/write memory 20. Memories 16 and 18 are preferably programmable read only memories (PROMS) since they contain permanent data repeatedly used by the microprocessor during the course of a game and during the course of a test routine. Memory 20 is a dynamic memory in which game score, balls in play and similar temporary data is stored and retrieved. The three memories are connected to the microprocessor by means of the data bus 12 and the address bus 14. It will be understood that these buses include a plurality of lines for bit transfer in the usual manner.

The program memory 16 is the same for all pinball games of a given design. Memory 18, however, differs for each type of game depending on the number, location and type of game elements involved as, for example, the number and position of lights, the number of digits of game score involved and the number of ball ejectors. Once the system characterization or game PROM memory 18 is installed, the microprocessor can be considered programmed for a particular game. In order to use the microprocessor in a different game, it is only necessary to change the game PROM 18 rather than reprogramming the program control memory 16.

The various lamps and targets are controlled by lamp drivers 22 and solenoid drivers 24. Typically, the lamps are used to indicated bonus value of certain targets during portions of the game and otherwise to make the game more attractive to the player. The solenoid drivers 24 are used to reset trap or similar targets of the type which move when struck by the pinball. The microprocessor maintains control over the lamp illumination and the operation of the solenoids by selectively operating the lamp drivers and solenoid drivers. This is accomplished through a network of driver latches 26 which select the correct lamp and/or solenoid for operation according to the game program provided in the memory 18.

In addition to lamps and trap targets, a typical pinball game includes a plurality of switches which are operated by the pinball striking them. Typically, these switches produce a score increment or cause the operation of an auxiliary feature of the game as, for example, an extra game, an extra ball, bonus point scoring, and the like. In a typical pinball game a plurality of such switches are involved and, accordingly, the switches are connected across a row and column switch matrix 28. Detection of which switches in the matrix have been operated is determined by polling across the rows of the matrix to produce an output to the microprocessor via a column buffer 32. When the microprocessor polls the switch matrix via row drivers 30 it sequentially applies a signal to each row in the matrix. Any switch which has been operated will provide an output connecting the pulsed row with a specific output column in a manner to be described. This identifies which switch has been closed and permits the microprocessor to take the appropriate action responsive to detection of that switch closing. In this manner the game score is incremented, the game is ended at the appropriate time and the auxiliary features referred to previously come into play.

Incorporated into the switch matrix 28 is a test sequencing circuit 34 which is a principal feature of the present invention. The sequencing circuit includes a set of switches which, when activated, instruct the microprocessor to perform a test routine charted in FIG. 4. This test routine permits the selection of a continuous sequential operation of all switches or, alternatively, a single stepping through each of the switches with a repetition as many times as necessary to determine the source of a game defect and to correct it. It is desirable that the particular switch operating the microprocessor be number coded to a service manual and that the number code of the switch be displayed on the game scoring readouts.

Figure 2:
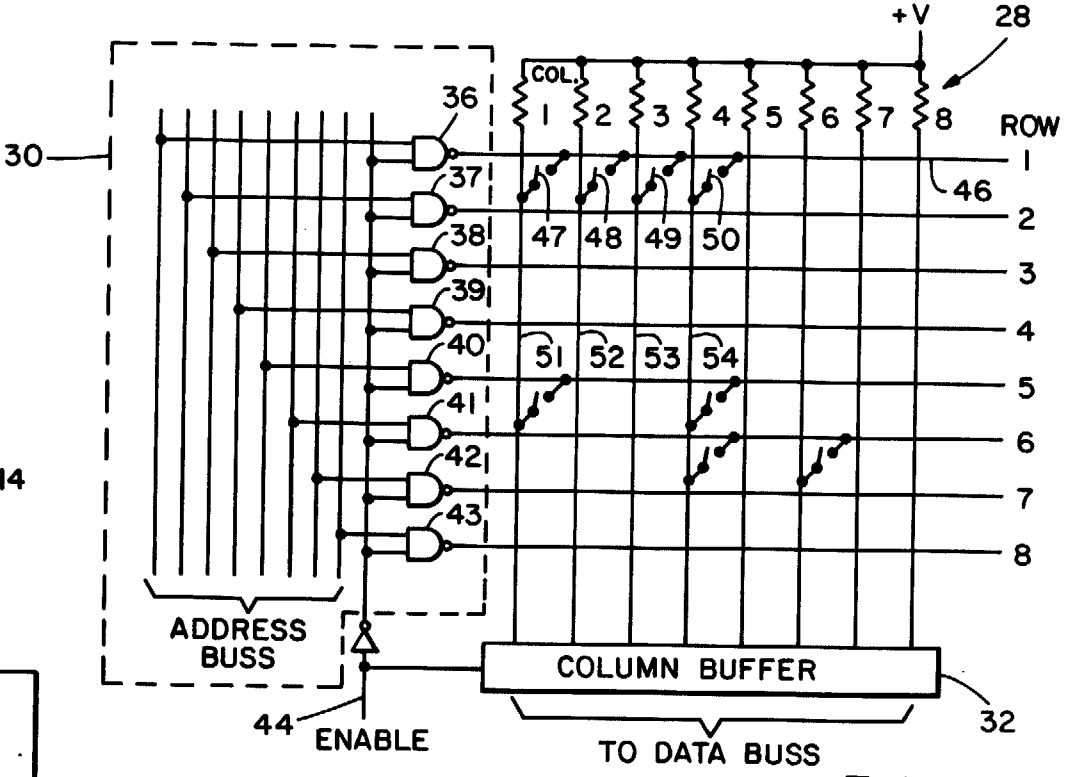
FIG. 2 is a schematic drawing of the switch matrix portion of the circuit.
Figure 3:
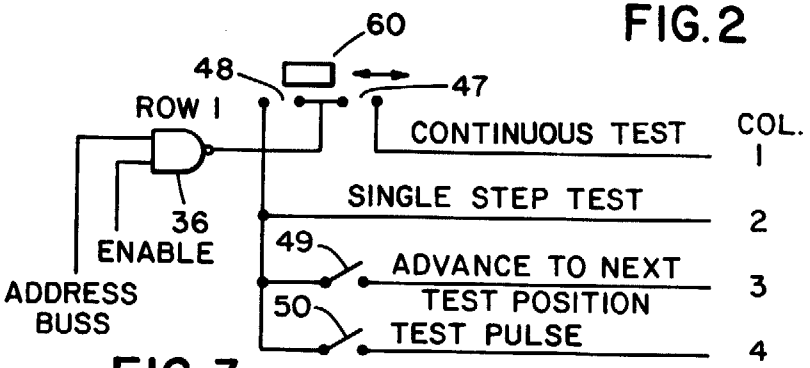
FIG. 3 is a schematic drawing of the test sequence portion of the circuit.

Referring now to FIGS. 2 and 3, the switch matrix 28, the matrix row driver 30, and the column buffer 32 are illustrated. When the microprocessor polls the switch matrix it applies, in sequence, a pulse to each of the NAND gates 36 through 43. Thus, when row 1 is to be polled, NAND gate 36 is pulsed at the same time that an enable signal is provided on line 44. The switch matrix 28 is illustrated as an $8 \times 8$ row and column matrix. It will, of course, be appreciated that a greater or lesser sized matrix could be utilized depending upon the complexity of the game. For purposes of clarity, the matrix is illustrated as having only a small number of switches connected between the row and column conductors. Connected to conductor 46, the row 1 conductor, are four switches 47–50. Each switch is connected to a different one of column conductors 51 through 54, respectively. Thus, when a pulse is provided to NAND gate 36, if any of switches 47–50 are closed, an output pulse will be provided on a corresponding one of column conductors to the column buffer 32. In turn, this output is provided to the data bus and received by the microprocessor 10.

Other switches illustrated in the switch matrix are polled in a similar manner to detect whether or not they have been actuated. Most of the switches illustrated in the matrix 28 correspond to the various game switches provided on the game surface. Switches 47 through 50, however, correspond to the test circuit switches.

FIG. 3 illustrates the manner in which the test sequencer circuit 34 is connected to various points on the switch matrix 28. For illustrative purposes the four switches on the test sequencer 34 are connected to row 1 of the switch matrix and to columns 1 through 4, respectively. The test sequence circuit comprises a two pole switch mechanism 60 as well as single pole switches 49 and 50. When it is desired to operate the test routine the switch mechanism 60 is moved so that either switch 47 or switch 48 is closed. If switch 47 is closed, the microprocessor is instructed to begin a continuous test routine in which each light, switch, and ejector testing positions is operated in sequence. At the completion of the automatic cycle it begins again and will repeat until the switch 47 is opened.

In the second position switch 48 is closed. This initiates the single step test routine by the microprocessor. When switch 48 is closed, the test routine is controlled by operation of switches 49 and 50. Each time a light, switch or ejector is to be operated switch 50 is manually closed by the technician servicing the game. The switch, light or ejector can be operated as often as desired simply by operating switch 50.

If, for example, a light bulb has burned out, the technician can detect which bulb does not light in the sequence and then stop and replace the bulb. After replacement of the bulb he can again close switch 50 to insure that he has repaired the device. If the bulb again fails to light, he immediately knows that he has not yet solved the problem and must continue to trouble shoot. After he has successfully repaired the light a final depression of the switch 50 will illuminate the light indicating that the repair has been completed.

At that point the technician will operate switch 49 to advance the program to the next switch test position. The technician then reverts to operation of switch 50 to test whichever light switch or ejector is at the new test position. In this manner the entire test routine may be single stepped through and repetitively operated at any given test position until detected trouble is diagnosed and cured.

A typical operating procedure for a service technician would be to connect the sequencing circuit and initially use the continuous test position. If he detects any light, switch, etc., which fails to operate during the continuous test portion, he would switch to the single step mode and step the test program through to the point where the defective element is tested. He would then diagnose and correct the problem and insure that it is satisfactorily operating by repeated use of switch 50 in the manner described.

Based on the foregoing discussion with respect to the means specified, it will be apparent to those skilled in the art of microprocessor programming and pinball game design the manner in which the microprocessor is programmed to provide a test routine for all of the switches, lights and ejectors. Nevertheless, in order to provide a complete disclosure of the invention, FIG. 4 illustrates the test routine flow diagram for programming the microprocessor. From this diagram a computer programmer can easily provide the necessary program to achieve the desired functions set forth. Referring to FIG. 4 it will be observed that at the start of each microprocessor cycle it scans the switch matrix. If no switches are closed, it terminates its scan and begins again. If neither switch 47 nor 48 is closed, the test routine is not in effect and the microprocessor continues through the normal game program at 72.

If the continuous test switch 47 is closed, a first segment of the test sequence is initiated. The first time through the continuous test sequence all the score displays show the number eight so that any burned out segment of the seven segment displays can be detected. After setting the displays to eight at 73 the first test position is enabled and its output is operated at 74 and 75. It is maintained on for a sufficient period to permit the technician to detect its operation and then it is turned off. This completes the first microprocessor cycle during the continuous test program. During the second cycle block 76 instructs the microprocessor to advance to the next test position and again perform a turn on and turn off for observation by the technician. At the last test position the first test position is again selected so that a repetitive continuous test is produced which will continually cycle through all of the test positions as long as switch 47 is closed. In this manner a technician can, of course, continue to observe the game for as long a period of time as necessary to satisfy him that operation is as desired.

When switch 48 is closed rather than switch 47 the single step test program is called up as indicated at 77. This routine detects whether or not the advance switch 49 has been closed, whether or not switch 50 has been closed and takes appropriate action. At 78 an additional feature not present in the continuous test is included. This feature instructs the microprocessor to display the number of a closed switch on the numerical display segments. This is particularly helpful with respect to the switches and ejectors. In order to see if such a switch or ejector is working the technician merely drops a ball into the ejector or manually operates the switch. If it is working its output will be detected by the microprocessor. Box 78 represents program instructions which will cause the number of the switch detected to be displayed.

While I have shown and described embodiments of this invention in some detail, it will be understood that this description and illustrations are offered merely by way of example, and that the invention is to be limited in scope only by the appended claims.

I claim:

1. A control and test circuit for electronic pinball type game devices having lights, ball switches, ball ejectors and score display means responsive to movement of a pinball over the game surface, said circuit comprising a. driver means for operating specified lamps and ball ejectors, b. a switch matrix means having a plurality of switches connected thereto, said switches being operated by ball contact with various locations on said game surface, c. computer means for monitoring said switch matrix means and controlling said driver means and said score display means responsive to detecting switch operation in accordance with a program therefor, and d. test sequencing means connected to said switch matrix means for causing said computer means to sequentially operate each light, ejector, and switch position to test said game, said sequencing means including means for repetitively testing a given light, ejector or switch position before proceeding to the next test position.

2. The device of claim 1 wherein said plurality of switches are connected to said matrix means in row and column fashion whereby a closed switch will uniquely connect a given row to a given column.

3. The device of claim 2 wherein said matrix means includes a. a matrix row driver for permitting said computer means to sequentially poll each row of said matrix means and b. a matrix column buffer which provides an output to said computer means indicative of an operated switch in any column of said matrix means.

4. The device of claim 1 wherein said computer means includes a microprocessor.

5. The device of claim 1 wherein said computer means includes:

a. a microprocessor, b. a first read only memory for storing general programming information for electronic pinball games, c. a second read only memory for storing program information for a specific pinball game.

6. The device of claim 1 wherein said test sequence means include a plurality of manually operable switch means connected in said matrix means for initiating and controlling operation of said computer means during testing of said pinball game.

7. The device of claim 6 wherein said switch means includes:

a. a first switch which directs said computer means to initiate a continuous sequential test of said test positions, b. a second switch which directs said computer to initiate a single position test operation, and c. means for permitting either, but not both, of said first and second switches to be operated at a given time.

8. The device of claim 7 wherein said switch means includes a third switch for causing said computer means to repetitively test a given position when said single position test is selected.

9. The device of claim 8 wherein said switch means includes a fourth switch for causing said computer means to advance to the next test position when said single position test is selected.

10. The device of claim 7 wherein said switch means includes a fourth switch for causing said computer means to advance to the next test position when said single position test is selected.

* * * * *